US005103724A

United States Patent [19]

Greer et al.

[11] Patent Number: 5,103,724

[45] Date of Patent: Apr. 14, 1992

[54] PRINTING PRESS WITH REGISTER ADJUSTMENT MEANS

[75] Inventors: Larry J. Greer, Chesterfield; Mikhail Goldburt, St. Louis, both of Mo.

[73] Assignee: Allied Gear & Machine Company, St. Louis, Mo.

[21] Appl. No.: 753,071

[22] Filed: Aug. 30, 1991

[51] Int. Cl.[5] ..... B41F 5/02; B41F 13/14

[52] U.S. Cl. ..... 101/183; 101/248

[58] Field of Search ..... 101/181, 248, 183, 178, 101/179, 180, 182, 184, 216, 219

[56] References Cited

U.S. PATENT DOCUMENTS 1,972,840 9/1934 Graf ..... 101/247

2,163,035 6/1939 Grupe ..... 101/248

*Primary Examiner*—J. Reed Fisher

*Attorney, Agent, or Firm*—Cohn, Powell & Hind

[57] ABSTRACT

This adjustment mechanism (30) is for a printing press (10) providing a train of modules (12) driven by a common lineshaft (20) having a ninety degree (90°) drive for a roll 18. The drive includes a worm (22) mounted to the lineshaft (20) engaging a worm gear (24) carried by the roll (18) such that axial movement of the worm (22) rotates the worm gear (24) and adjusts the register of the roll. The adjustment mechanism (30) includes a threadedly extensible member (50) engageable with one side of the worm (22) to urge the worm (22) in one direction and a compression spring (52) mounted on the other side of the worm (22) to urge the worm (22) in the opposite direction.

9 Claims, 2 Drawing Sheets

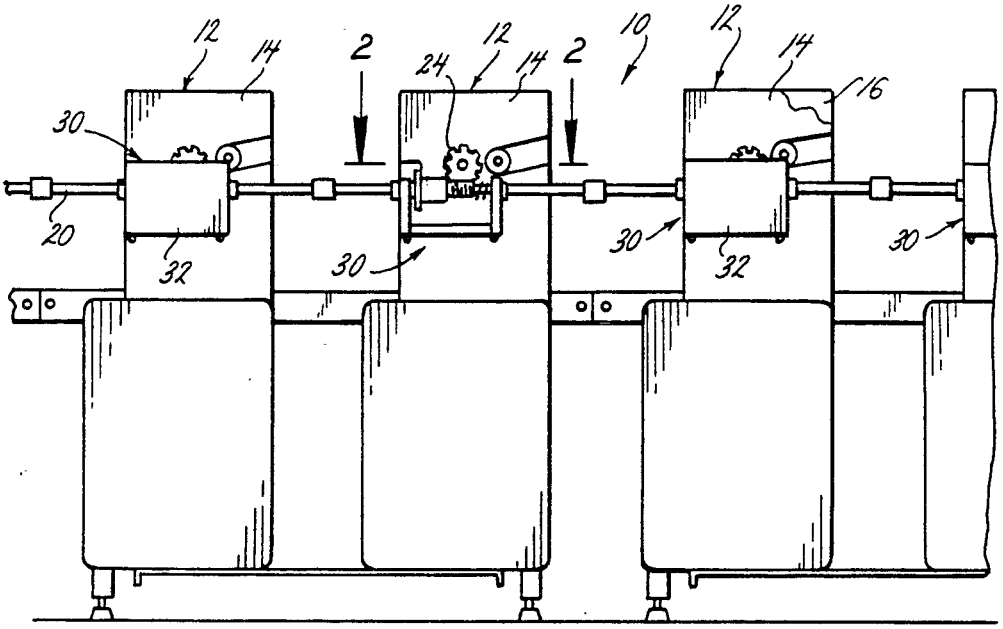
FIG. 1.
FIG. 4.
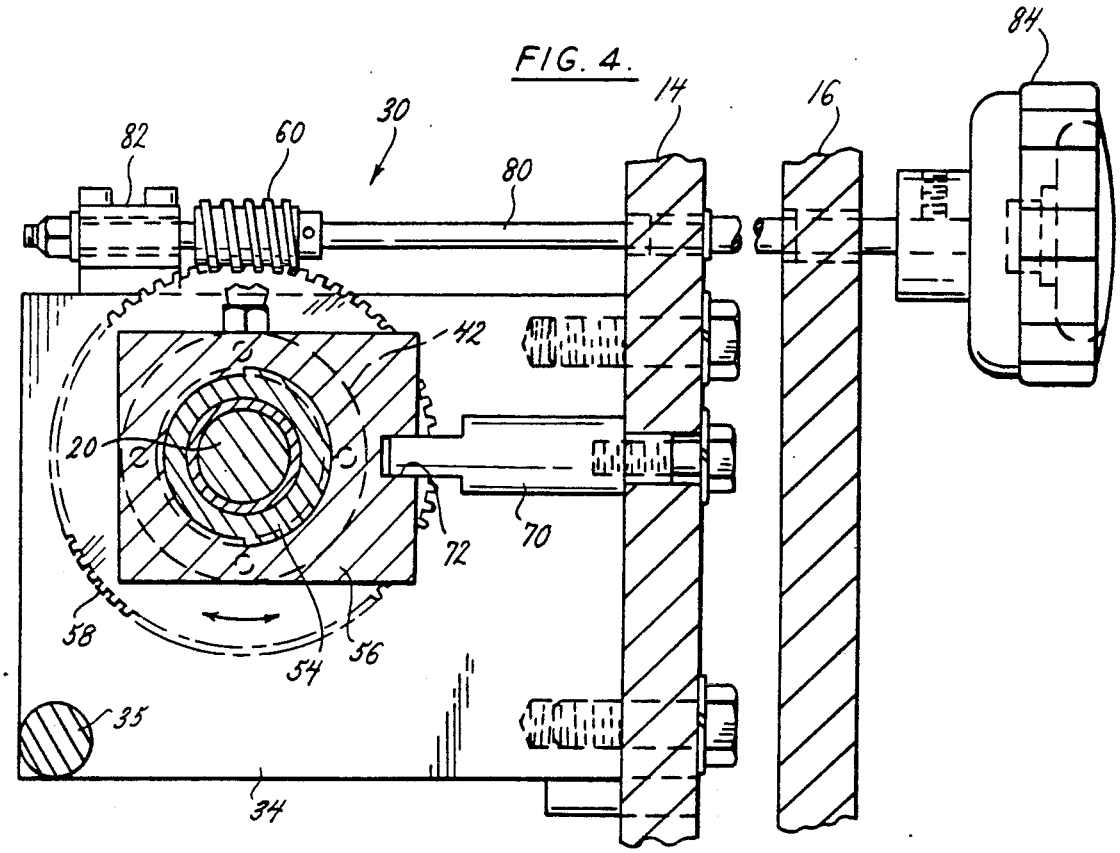

PRINTING PRESS WITH REGISTER ADJUSTMENT MEANS

BACKGROUND OF THE INVENTION

This invention relates generally to lineshaft driven printing presses and more particularly to the adjustment of the rolls of individual modules to ensure that the individual modules are in register.

Lineshaft driven printing presses have a succession of individual modules driven by a single drive. Each module has rolls driven through ninety degree (90°) gear boxes and some means is necessary to provide phase shifting of one module relative to the other so that there is accurate registration between modules. In the prior art one means of achieving the necessary registration has been to provide the ninety-degree (90°) gear box with secondary mechanisms to provide the phase shifting function. This is an expensive solution and incompatible with the need in the industry to provide a relatively inexpensive yet accurate printing press of this type.

Some press manufacturers have attempted to overcome the problem by using worm/worm gear drives to provide the ninety degree (90°) drive in which some means has been provided to move the worm axially along the shaft to achieve a phase shift in the worm gear, and hence in the roll system. The results have not been encouraging and prior art attempts have not been successful. Durability has been limited, the mechanisms have lacked smooth operation resulting in unreasonable wear, and the range of register adjustment has been limited.

This register adjustment means solves these and other problems in a manner not revealed in the known prior art.

SUMMARY OF THE INVENTION

There has been a need in the printing industry for a relatively small, economical flexographic printing press. In order to fill this need the present invention is one of several, companion inventions which simplify particular independent features of such a press namely: a printing press register adjustment means, a printing press support structure, a meter roll mounting means and an anilox roll mounting means. The register adjustment means, is disclosed herein, the other three features are disclosed in companion U.S. patent applications Ser. No. 07/753069, Ser. No. 07/753406 and Ser. No. 07/753324, respectively, all filed Aug. 30, 1991, assigned to the assignee hereof and all incorporated herein by reference.

This invention provides an accurate register adjustment means for a lineshaft driven printing press by utilizing an open style worm/worm gear drive directly coupled to the driven module without requiring additional gearing.

The invention utilizes a floating screwbox riding upon the lineshaft and in direct contact with the worm which is free to slide axially on the lineshaft but is keyed against rotation relative to the lineshaft.

In a printing press of the type having a plurality of modules each having a roll driven by a common lineshaft drive, a register adjustment means for each module, it is an aspect of this invention to provide a printing press module including first and second opposed sideframes, a roll having a shaft mounted between said sideframes and said shaft having an end extending outwardly of said first sideframe including a worm gear disposed thereon; a lineshaft mounted in perpendicular relation to the roll shaft and including a worm having opposed ends and mounted in axially slidable relation to said lineshaft but rotatable with said lineshaft, and means for incrementally moving said worm axially of the lineshaft to rotate said worm gear and thereby adjust the register of the roll said moving means including threadedly extensible means operatively engaging one end of the worm to urge the worm axially in one direction, and resilient means operatively engaging the other end of the worm tending to urge said worm in the other direction.

It is another aspect of this invention to provide that the threadedly extensible means includes first and second threadedly connected members mounted to the lineshaft and having an end abutment operatively engageable with said worm, means rotating said first member and means holding said second member against rotation to urge said worm axially in said one direction.

It is yet another aspect of this invention to provide that the first threaded member includes a sleeve carried by said lineshaft in axially fixed relation and relatively rotated on said lineshaft by said rotating means, and the second threaded member includes a block receiving said sleeve and held against rotation on said lineshaft by said holding means.

It is still another aspect of this invention to provide that said rotating means includes a worm gear fixedly connected to said sleeve and a manually rotatable worm, and said holding means includes a fixed key received by said block in sliding relation.

In another aspect of this invention the mounting means for the lineshaft include axially spaced first and second mounting plates carried by the first sideframe, the threadedly extensible means includes a sleeve carried by said lineshaft and operatively abuting said first mounting plate and relatively rotatable on said lineshaft by said rotating means, and a block receiving said sleeve and held against rotation by said holding means, said block including an end abutment operatively engageable with one end of said worm means, and said resilient means includes a compression spring disposed about said lineshaft and extending between the other end of said worm means and said other mounting means.

In yet another aspect of this invention the rotating means includes a worm gear attached to the sleeve means and a shaft operatively carried, at least in part, by said first mounting plate.

In still another aspect of this invention the rotating means shaft is supported between said first and second sideframes and said shaft extends outwardly of said first sideframe and is supported at an adjacent remote end by said first mounting plate and extends outwardly of said second sideframe and includes an adjacent remote end having a control knob fixedly attached thereto.

In another aspect of this invention a thrust bearing is disposed between said sleeve and said first mounting plate and between said compression spring and said second mounting plate.

In still another aspect of this invention said lineshaft is disposed below said worm gear.

It is an aspect of this invention to provide a register adjustment means which is relatively inexpensive to manufacture, easy to install and highly effective in operation.

BRIEF DESCRIPTION OF THE DRAWINGS

FIG. 1 is an elevational view of a printing press with interconnected modules;

FIG. 4 is a cross sectional view taken on line 4—4 of FIG.3.

DESCRIPTION OF THE PREFERRED EMBODIMENT

Figure 2:
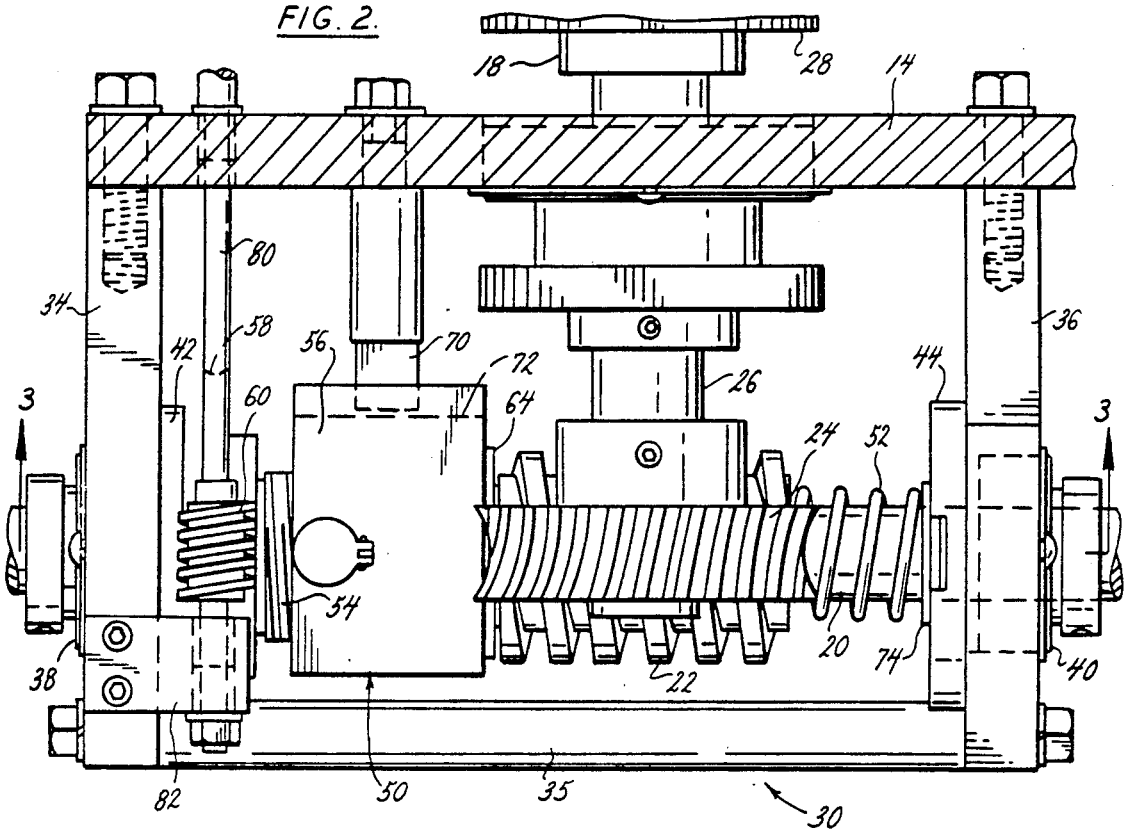
FIG. 2 is a plan view of the adjustment means taken on line 2—2 of FIG. 1.

Referring now by reference numerals to the drawings and first to FIG. 1 it will be understood that the printing press 10 generally indicated by numeral 10 includes a plurality of substantially identical rail-connected modules 12, arranged in pairs in the embodiment shown. Each module includes a pair of first and second sideframes 14 and 16 supporting a roll system (not shown). The roll system typically includes a meter roll, an anilox roll, a plate roll and an impression roll. In the embodiment described the impression roll, indicated by numeral 18, is driven by a lineshaft 20 through a ninety degree (90°) drive which includes a worm 22 carried by the lineshaft 20 and engaging a worm gear 24 carried by the impression roll 18. The impression roll 18 is carried by a shaft 26 which extends between and is supported by sideframes 14 and 16. The shaft 26 also carries a drive gear 28 which drives the anilox roll (not shown).

The roll systems of the individual modules 10 require register adjustment and the adjustment means 30 for one of the modules 12 will now be described, it being understood that the same adjustment means is provided for each module.

Figure 3:
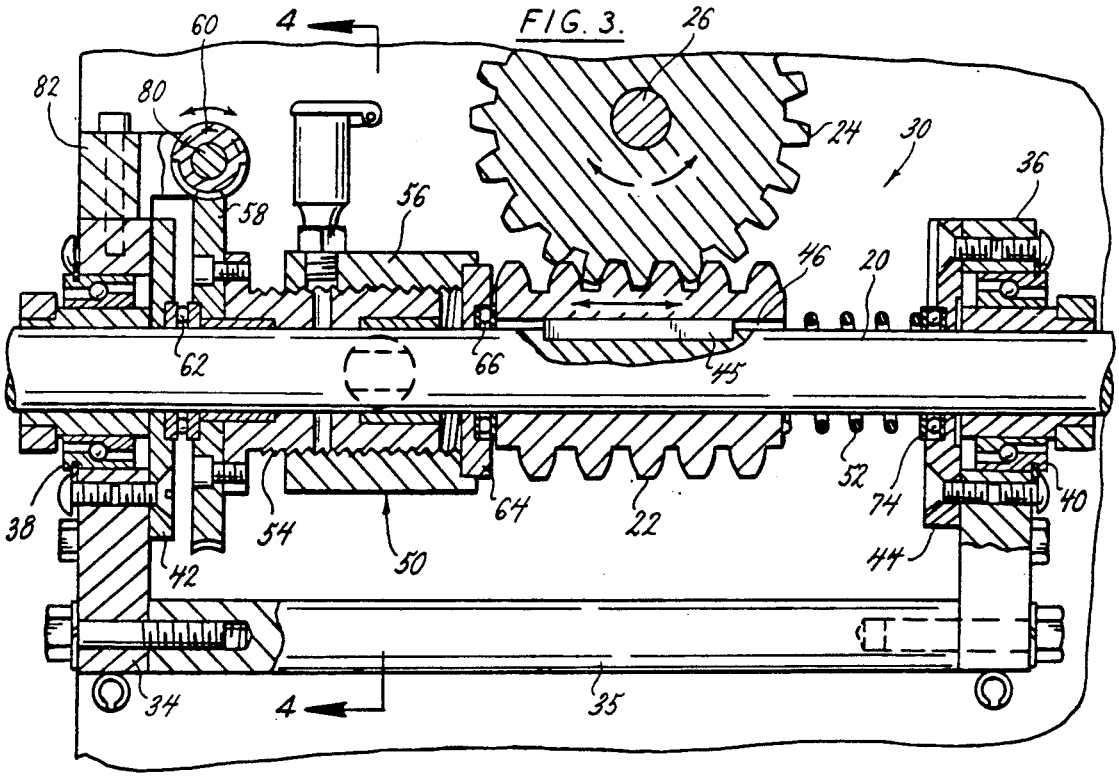
FIG. 3 is a longitudinal sectional elevational view taken on line 3—3 of FIG. 2.

Referring now to FIGS. 2–4 and first to FIG. 2, it will be understood that the adjustment means 30 is shown with the cover 32 removed. The lineshaft 20 is supported by fore and aft oppositely disposed mounting plates 34 and 36 interconnected by a stabilizer bar 35, as by fasteners. The mounting plates 34 and 36 include aligned bearing assemblies 38 and 40, respectively, held in place, as by fasteners, and by oppositely facing keep plates 42 and 44 also held in place as by fasteners. By this structural arrangement of parts the lineshaft 20 is firmly held against fore and aft movement.

The worm 22 is mounted to the lineshaft 20 by a key 45 to prevent relative rotational movement between the worm 22 and the lineshaft 20, the worm having an axial groove 46 to permit relative axial movement between said worm and said lineshaft.

A threadedly extensible member 50, of the type referred to as a floating screw box, is mounted to the lineshaft 20 on one side of the worm between mounting plate 34 and one end of the worm 22, and a compression spring 52 is mounted on the other side of the worm between mounting plate 36 and the other end of said worm said extensible member and said resilient member constituting moving means.

The extensible member 50 includes an externally threaded sleeve 54 and an internally threaded block 56 receiving said sleeve. The sleeve 54 includes spaced bushings and an annular flange to which a control worm gear 58 is attached as by fasteners, the worm gear being rotatable by a control worm assembly 60 constituting rotating means. A thrust bearing 62 is disposed between the worm gear 58 and the keep plate 42. The block 56 includes a fixed end plate 64 having a thrust bearing 66 and providing an abutment which engages the end of the worm 22. A key 70 which is fixedly attached to the sideframe 14 is received by a groove 72 provided in the block 56 to prevent rotatively movement of the block 56 but permit relative axial movement of the block relative to the lineshaft 20 said key and groove constituting holding means. A thrust bearing 74 is provided for the compression spring 52 between the end of said spring and the keep plate 44.

The control worm 60 is fixedly attached to a shaft 80 which is mounted between sideframes 14 and 16 and, as best shown in FIG. 3, extends outwardly of each of said sideframes. The end of the shaft 80, adjacent sideframe 14, is supported by a bearing block 82 carried by and attached to mounting plate 34, as by fasteners. The other end of the shaft 80, adjacent sideframe 16, includes a fixedly attached knob 84, by which said shaft and therefore the worm 60 and worm gear 58 are rotated.

It is thought that the structural features and functional advantages of this adjustment means have been fully understood by the foregoing description of parts. However, for completeness of disclosure the operation of the adjustment means to bring the impression roll 18 of each of the individual modules 12 into register will be briefly described.

The lineshaft 20 drives each of the impression rolls 18 through the medium of the ninety degree (90°) drive provided by the worm 22 mounted to the lineshaft 20 and the worm gear 24 carried by the impression roll shaft 26. It will be understood, particularly from FIG. 2 that relative axial movement of the worm 22 on the lineshaft 20, in a fore or aft direction, rotates the worm gear, clockwise or counterclockwise respectively, thereby directly affecting the rotational location or "register" of the impression roll 18 to which the worm gear 24 is fixedly attached.

The worm 22 is moved axially relative to the lineshaft 20 by extension or retraction of the threadedly connected parts 54, 56 of the extensible means 50. This extension or retraction is in turn achieved by rotating the control worm 60 which rotates worm gear 58 fixedly attached to the end of the sleeve 54, block 56 being precluded from rotating by provision of the Key 70. Thus an operator on the side of the printing press opposite the adjustment mechanism can readily effectuate correct register of the impression rolls remotely by simply turning the control knob 84 at the operator's side.

The provision of the compression spring 52 simplifies the adjustment means substantially and eliminates backlash.

In the embodiment shown, the worm 22 is disposed below the worm gear 24. It is possible, however, to reverse this arrangement which would result in the opposite rotation of the worm gear 24 upon axial movement of the worm 22. Also, the control worm 60 can be vertically disposed relative to the control gear 58 if it is desired to carry out the control operation same side of the press as the adjustment means.

In view of the above it will be understood that various aspects and features of the invention are achieved and other advantageous results are attained. While a preferred embodiment of the invention has been shown and described, it will be clear to those skilled in the art that various modifications may be made without departure from the invention in its broader aspects.

We claim as our invention:

1. In a printing press of the type having a plurality of modules each having a roll driven by a common lineshaft drive, a register adjustment means for each module:

a printing press module including first and second opposed sideframes, a roll having a shaft mounted between said sideframes and said shaft having an end extending outwardly of said first sideframe including a worm gear disposed thereon, a lineshaft mounted in perpendicular relation to the roll shaft and including a worm having opposed ends and mounted in axially slidable relation to said lineshaft but rotatable with said lineshaft;

means operatively mounting said lineshaft to said first sideframe, means for incrementally moving said worm axially of the lineshaft to rotate said worm gear and thereby adjust the register of the roll, said moving means including threadedly extensible means operatively engaging one end of the worm to urge the worm axially in one direction, and resilient means operatively engaging the other end of the worm tending to urge said worm in the other direction.

2. An adjustment means as defined in claim 1, in which:

the threadedly extensible means includes first and second threadedly connected members mounted to the lineshaft and having an end abutment operatively engageable with said worm, means rotating said first member and means holding said second member against rotation to urge said worm axially in said one direction.

3. An adjustment defined in claim 2, in which:

the first threaded member includes a sleeve carried by said lineshaft in axially , fixed relation and relatively rotated on said lineshaft by said rotating means, and the second threaded member includes a block receiving said sleeve and held against rotation on said lineshaft by said holding means.

4. An adjustment means as defined in claim 3 in which: said rotating means includes a worm gear fixedly connected to said sleeve and a manually rotatable worm, and said holding means includes a fixed key received by said block in sliding relation.

5. An adjustment means as defined in claim 2 in which:

the mounting means for the lineshaft include axially spaced first and second mounting plates carried by the first sideframe, the threadedly extensible means includes a sleeve carried by said lineshaft and operatively abuting said first mounting plate and relatively rotatable on said lineshaft by said rotating means, and a block receiving said sleeve and held against rotation by said holding means, said block including an end abutment operatively engageable with one end of said worm, and said resilient means includes a compression spring disposed about said lineshaft and extending between the other end of said worm and said other mounting plate.

6. An adjustment means as defined in claim 5, in which:

the rotating means includes a worm gear attached to the sleeve means and a shaft operatively carried, at least in part, by said first mounting plate.

7. An adjustment means as defined in claim 6, in which:

the rotating means shaft is supported between said first and second sideframes and said rotating means shaft extends outwardly of said first sideframe and is supported at an adjacent remote end by said first mounting plate and extends outwardly of said second sideframe and includes an adjacent remote end having a control knob fixedly attached thereto.

8. An adjustment means as defined in claim 5, in which:

a thrust bearing is disposed between said sleeve and said first mounting plate and between said compression spring and said second mounting plate.

9. An adjustment means as defined in claim 1, in which:

said lineshaft is disposed below said worm gear.

* * * * *